US006824003B1

(12) United States Patent
Wong

(10) Patent No.: US 6,824,003 B1
(45) Date of Patent: Nov. 30, 2004

(54) DISPOSABLE LID FOR DRINKING CUP HAVING A RETRACTABLE DRINKING OPENING

(75) Inventor: Joseph Cheuk Mau Wong, Daly City, CA (US)

(73) Assignee: Double Team Inc., Daly City, CA (US)

( * ) Notice: Subject to any disclaimer, the term of this patent is extended or adjusted under 35 U.S.C. 154(b) by 0 days.

(21) Appl. No.: 10/408,481

(22) Filed: Apr. 7, 2003

(51) Int. Cl.[7] ..... B65D 51/18
(52) U.S. Cl. ..... 220/254.9; 220/719
(58) Field of Search ..... 220/256.9, 719, 220/713, 714, 703, 710.5, 717, 718, 253, 245.1, 245.2, 245.4, FOR 183–FOR 185, 259; 215/DIG. 7, 387; D9/447

(56) References Cited

U.S. PATENT DOCUMENTS

| | | | | | |
|---|---|---|---|---|---|
| 2,475,896 | A | * | 7/1949 | Husted | 206/259 |
| 2,480,733 | A | * | 8/1949 | Hermani | 222/560 |
| 3,174,661 | A | * | 3/1965 | Speicher | 222/545 |
| 3,938,690 | A | * | 2/1976 | Butler | 220/714 |
| 4,057,167 | A | * | 11/1977 | Lee | 220/715 |
| 4,170,724 | A | * | 10/1979 | Waterbury | 220/270 |
| 4,441,624 | A | * | 4/1984 | Sokolowski | 220/254.1 |
| D417,845 | S | * | 12/1999 | Sadlier et al. | D9/447 |
| 6,354,454 | B1 | * | 3/2002 | Wong | 220/345.1 |
| D476,566 | S | * | 7/2003 | Smith et al. | D9/447 |

FOREIGN PATENT DOCUMENTS

| | | | | |
|---|---|---|---|---|
| GB | 239036 | * | 9/1925 | |
| GB | 408194 | * | 7/1932 | 220/254.1 |

* cited by examiner

*Primary Examiner*—Lien Tm Ngo
(74) *Attorney, Agent, or Firm*—Sawyer Law Group LLP

(57) ABSTRACT

A disposable lid for a drinking cup the lid comprises a cover portion having a generally circular periphery, a drinking opening in the cover portion adjacent to the periphery, a handle opening in the cover portion, and at least one C-shaped rail that protrudes downwardly from an inside surface of the cover portion. The at least one C-shaped rail forms a longitudinal channel that extends from the handle opening to the drinking opening. The lid further comprises a sliding member having a handle. The sliding member is configured to slidably fit into the channel and have its handle extend through the handle opening in the cover portion, such that when a user places the handle in a first position, the sliding member uncovers the drinking opening and when the user places the handle in a second position, the sliding member covers the drinking opening.

13 Claims, 4 Drawing Sheets

DISPOSABLE LID FOR DRINKING CUP HAVING A RETRACTABLE DRINKING OPENING

FIELD OF THE INVENTION

The present invention relates to a disposable lid for a drinking cup and more particularly to a disposable lid having a retractable drinking opening.

BACKGROUND OF THE INVENTION

A disposable lid is commonly used to cover a disposable beverage cup to prevent the beverage from spilling out of the cup. The lid can incorporate an opening that allows a user to drink the beverage without removing the lid from the cup. Some lids have a releasable drinking flap that may be either pushed into the cup or pulled away from the cup to form the opening. One disadvantage of this type of lid is that it is difficult to manipulate the flap with one hand while holding the cup with the same hand.

Some lids have a preformed opening. Nevertheless, such a lid is problematic because the beverage can spill out of the opening if the user is bumped or if the cup is overturned.

A lid for a nondisposable commuter mug utilizes an H-shaped flap that slides over a preformed opening, which alleviates spillage. Nevertheless, such a lid for a commuter mug is not disposable, is bulky and is relatively expensive to manufacture. Moreover, the H-shaped flap design is not feasible for a disposable lid because the disposable lid is typically manufactured from a thin plastic material that does not exhibit the rigidity required to produce an effective 11-shaped flap.

Accordingly, a need exists for a disposable lid for a cup that incorporates an opening through which a user can drink a beverage without removing the lid. The lid should prevent the beverage from spilling out of the cup when the user is not drinking from the cup. The user should be able to manipulate the lid with one hand. In addition, the lid should be relatively inexpensive to manufacture, and easy to assemble and store. The present invention addresses such needs.

SUMMARY OF THE INVENTION

A disposable lid for a drinking cup is disclosed. In a preferred embodiment, the lid comprises a cover portion having a generally circular periphery, a drinking opening in the cover portion adjacent to the periphery, a handle opening in the cover portion, and at least one C-shaped rail that protrudes downwardly from an inside surface of the cover portion. The at least one C-shaped rail forms a longitudinal channel that extends from the handle opening to the drinking opening. The lid further comprises a sliding member having a handle. The sliding member is configured to slidably fit into the channel and have its handle extend through the handle opening in the cover portion, such that when a user places the handle in a first position, the sliding member uncovers the drinking opening and when the user places the handle in a second position, the sliding member covers the drinking opening.

Through the aspects of the present invention, the user can hold the cup with one hand and, with the same hand, easily cover and uncover the drinking opening. Thus, when the user is not drinking, the user can cover the opening and prevent the beverage from spilling out of the cup. In addition, the lid helps to maintain the temperature of the beverage. In one preferred embodiment, the end of each rail is tapered so that the sliding member can snap into place, thereby allowing easy assembly.

DETAILED DESCRIPTION

The present invention relates to a disposable lid for a drinking cup and more particularly to a disposable lid having a retractable drinking opening. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
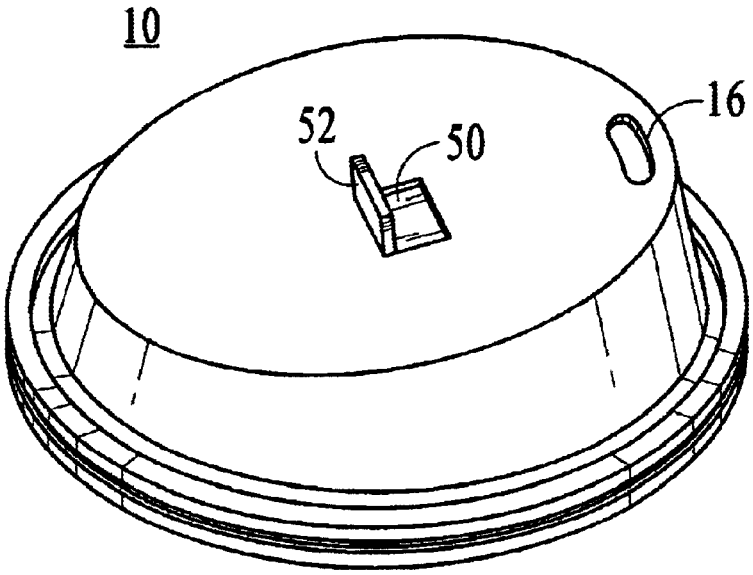
FIG. 1 is a perspective view of a lid according to a preferred embodiment of the present invention.

The present invention is generally embodied in a disposable lid for a drinking cup. The lid may be used with cups of various types, and is particularly suitable for use with disposable cups of the type commonly used as carry-out containers for beverages such as coffee and the like. FIG. 1 is a perspective view of a lid according to a preferred embodiment of the present invention. The disposable lid comprises a cover portion 10 that has a preformed drinking opening 16 and a sliding member 50 that covers and uncovers the drinking opening 16.

Figure 2A:
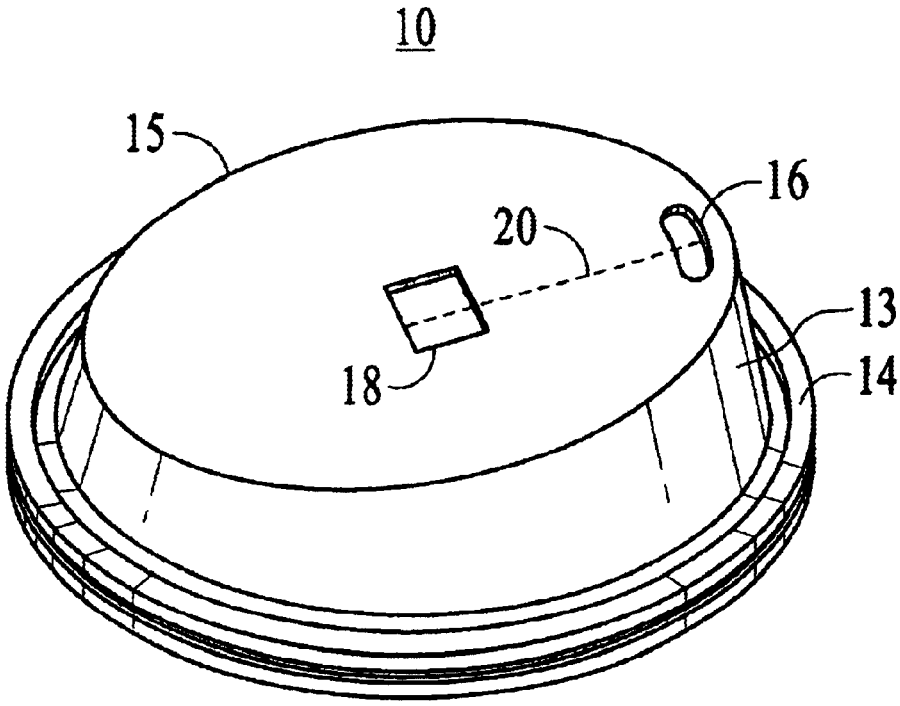
FIG. 2 is a perspective view of a cover portion of the lid in accordance with a preferred embodiment of the present invention.

FIG. 2A is a perspective view of the cover portion 10 of the lid in accordance with a preferred embodiment of the present invention, where like elements have like reference numerals. The cover portion 10 has a generally circular periphery 15, and includes a drinking opening 16 adjacent to the periphery 15 that allows the user to drink from the cup without removing the lid 10. The cover portion 10 includes an annular side wall 13 that extends downward from the periphery 15 to an annular mounting portion 14, which secures the cover portion 10 on the cup (not shown).

Figure 2B:
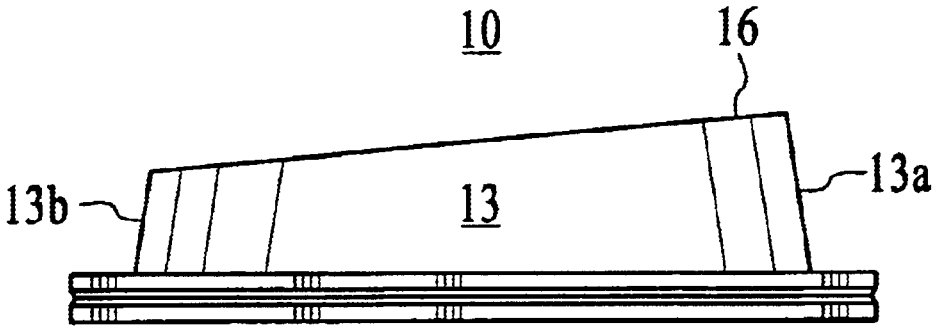

FIG. 2B is a side view of the cover portion 10 according to a preferred embodiment of the present invention. As is shown, the annular side wall 13 preferably is of varying height. In particular, it is highest at a point 13*a* adjacent to the drinking opening 16 and lowest at a point 13*b* directly opposite to the drinking opening 16. This variation in height minimizes the likelihood of the lid coming in contact with a user's upper lip (not shown) while the user is drinking out of the drinking opening 16.

Referring again to FIG. 2A, the cover portion 10 includes a handle opening 18. According to one preferred embodiment, the handle opening 18 is located along a radius 20 defined by the drinking opening 16. The handle opening 18 provides a means through which the user can manipulate the sliding member 50 (FIG. 1) to cover and uncover the drinking opening 16, and will be discussed in more detail below.

Figure 3:
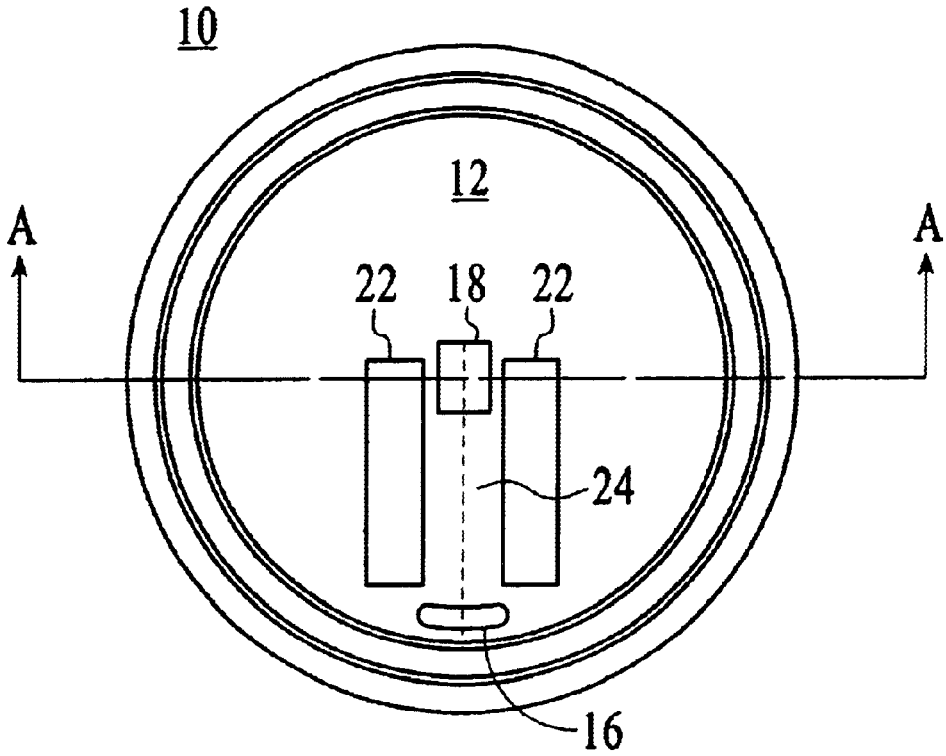
FIG. 3 is a plan view of an inside surface of the cover portion illustrated in FIG. 2.
Figure 4:
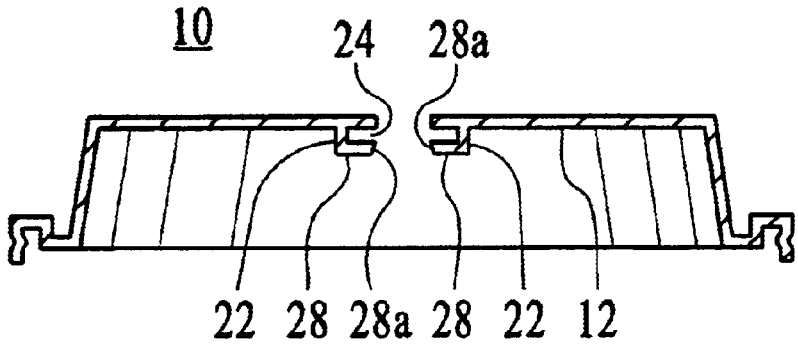
FIG. 4 is a cross-sectional side view of the cover portion taken along line A—A.

To describe further the cover portion 10 of the present invention, please refer to FIGS. 3 and 4. FIG. 3 is a plan view of an inside surface of the cover portion 10 according to the preferred embodiment of the present invention, and FIG. 4 is a cross-sectional side view of the cover portion 10 taken along line A—A, where like elements have like reference numerals. As is shown in FIGS. 3 and 4, the inside surface 12 of the cover portion includes at least one C-shaped rail 22 that protrudes down from the inside surface 12 of the cover portion. In a preferred embodiment, a pair of C-shaped rails 22 are positioned opposite to one another such that the rails form a longitudinal channel 24 that extends from the handle opening 18 to the drinking opening 16.

Figure 5A:
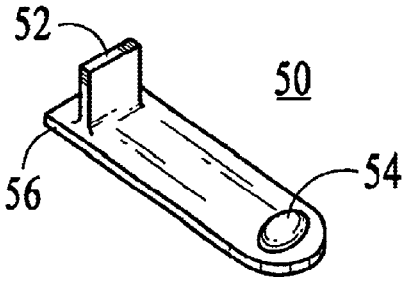
FIGS. 5A and 5B illustrate a perspective view and a side view, respectively, of the sliding member according to a preferred embodiment of the present invention.
Figure 5B:
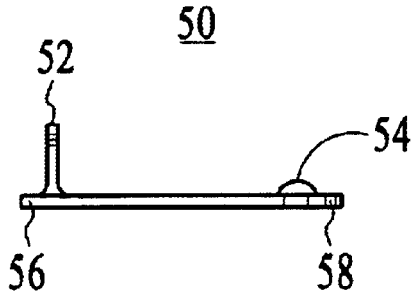

FIGS. 5A and 5B illustrate a perspective view and a side view, respectively, of the sliding member 50 according to a preferred embodiment of the present invention. As is shown, the sliding member 50 comprises a handle 52 that extends perpendicularly from one end 56 of the sliding member 50.

To describe the cooperation between the cover portion 10 and the sliding member 50, please refer to FIGS. 3, 4, 5A and 5B. The sliding member 50 is configured to fit within the channel 24 formed by the C-shaped rail(s) 22 so that the sliding member 50 can move longitudinally along the channel 24. The sliding member 50 is oriented so that the handle 52 protrudes through the handle opening 18 in the cover portion 10, as shown in FIG. 1. In a preferred embodiment, a bottom arm 28 of the C-shaped rail 22 is tapered at its free end 28*a* to facilitate snapping the sliding member 50 into the channel 24.

Figure 6A:
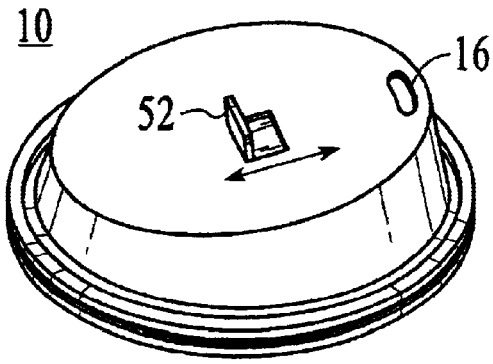
FIGS. 6A–6D illustrate the operation of the lid according to a preferred embodiment of the present invention.
Figure 6B:
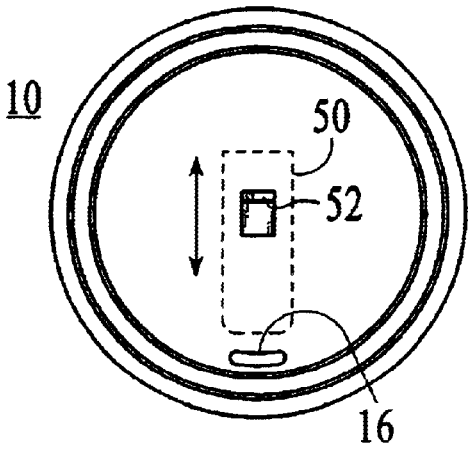
Figure 6C:
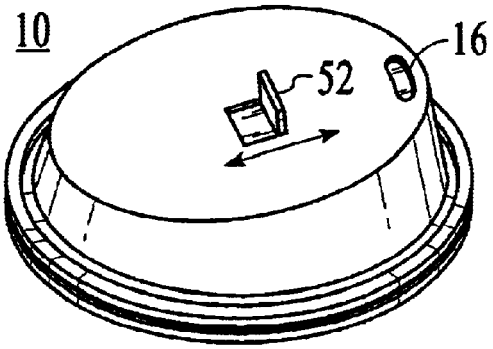
Figure 6D:
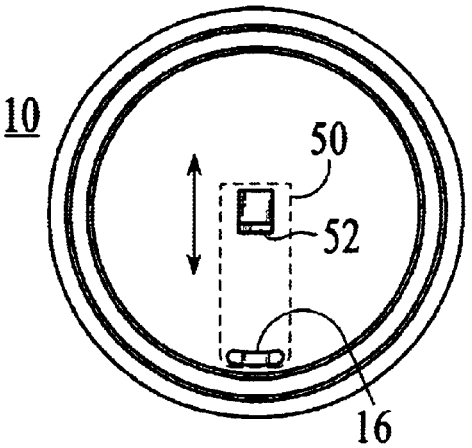

Refer now to FIGS. 6A–6D that illustrate the operation of the lid according to a preferred embodiment of the present invention. The user can move the sliding member 50 along the channel 24 by moving the handle 52 in a horizontal direction long the top of the cover portion 10 within the handle opening 18. When the handle 52 is placed in a first position, depicted in FIGS. 6A and 6B, the handle 52 is in a position farthest from the drinking opening 16. As is shown by the dashed lines in FIG. 6B, the sliding member 50 does not cover the drinking opening 16. When the user moves the handle 52 to a second position closest to the drinking opening 16, as shown in FIGS. 6C and 6D, the sliding member 50 covers the drinking opening 16, thereby preventing the cup contents from spilling from the cup.

According to one preferred embodiment, the sliding member 50 further includes a nub 54 (FIGS. 5A and 5B) at an opposite end 58 to the end 56 having the handle 52. When the handle 52 is in the second position (FIGS. 6C and 6B), the nub 54 fits into and plugs the drinking opening 16 to provide better protection against spillage.

Because the sliding member 50 moves easily within the channel 24, the user can move the handle 52 by applying directional pressure with one finger, e.g., an index finger, on the handle 52. Therefore, the user can easily manipulate the handle 52 with the same hand she is holding the cup.

Figure 7:
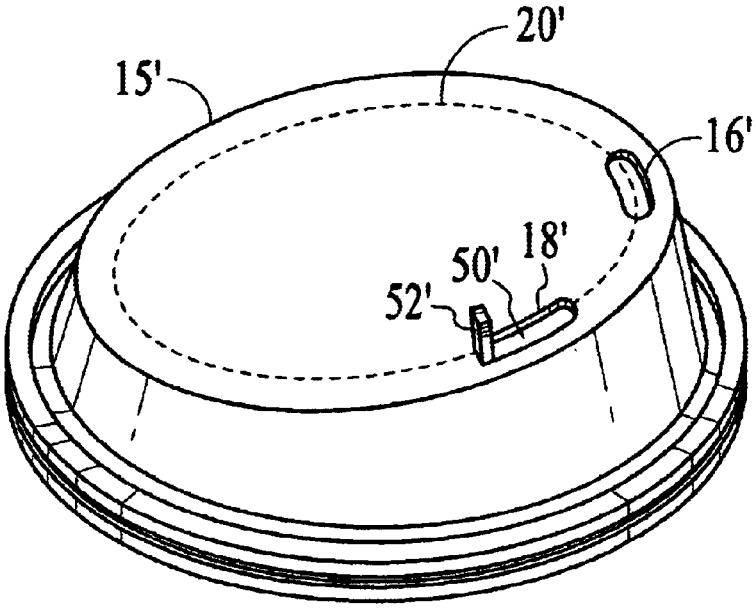
FIG. 7 is a perspective view of a lid according to a second preferred embodiment of the present invention.

In the preferred embodiment discussed above, the handle opening 18 is located along the radius 20 defined by the drinking opening 16 (FIG. 2A). Therefore, the sliding member 50 moves along the radius 20. FIG. 7 illustrates another preferred embodiment of the lid, whereby the handle opening 18' is located on a circumference 20' defined by the drinking opening 16.' In this embodiment, the sliding member 50' moves along the circumference 20.' Because the handle 52' of the sliding member 50' is closer to the cover portion's periphery 15,' a user with smaller hands can manipulate the handle 52' more easily.

Although the present invention has been described in accordance with the embodiments shown, one of ordinary skill in the art will readily recognize that there could be variations to the embodiments. For example, while the handle opening has been described as being located along a radius or circumference defined by the drinking opening, one skilled in the art would readily recognize that the handle opening can be located in different areas. Those variations would be within the spirit and scope of the present invention. Accordingly, many modifications may be made by one of ordinary skill in the art without departing from the spirit and scope of the appended claims.

What is claimed is:

1. A disposable lid for a drinking cup comprising:

a cover portion having a generally circular periphery, wherein the cover portion comprises an outside surface and an inside surface;

a drinking opening in the cover portion adjacent to the periphery;

a handle opening in the cover portion;

at least one C-shaped rail extending downwardly from the inside surface of the cover portion, wherein the at least one C-shaped rail comprises a top arm and a bottom arm, the top arm being coupled to the cover portion and the bottom arm positioned below the top arm, and wherein the at least one C-shaped rail forms a longitudinal channel, the channel extending from the handle opening to the drinking opening; and a sliding member, the sliding member comprising a handle and being configured to slidably fit into the channel and have the handle extend through the handle opening in the cover portion, wherein the bottom arm of each C-shaped rail is tapered at a free end such that the sliding member can be snapped into the channel;

wherein, when a user places the handle in a first position, the sliding member uncovers the drinking opening and when the handle is placed in a second position, the sliding member covers the drink opening.

2. The lid of claim 1, wherein the cover portion further comprising an annular mounting portion surrounding the cover portion periphery for securing the lid to the cup.

3. The lid of claim 1, wherein the handle opening is located along a radius defined by the drinking opening.

4. The lid of claim 3, wherein the user places the handle in the first position and in the second position by horizontally sliding the handle along the radius, thereby causing the sliding member to slide within the channel.

5. The lid of claim 1, wherein the handle opening is located along a circumference defined by the drinking opening.

6. The lid of claim 5, wherein the user places the handle in the first position and in the second position by horizontally sliding the handle along the circumference, thereby causing the sliding member to slide within the channel.

7. The lid of claim 1, wherein the sliding member further comprises a nub such that when the handle is placed in the second position, the nub plugs the drinking opening.

8. The lid of claim 1, wherein the lid is a thermoformed plastic lid.

9. The lid of claim 2, wherein the cover portion further comprising an annular side wall depending from the periphery and extending downward to the mounting portion, the side wall having a first height at a first point adjacent to the drinking opening and a second height at a second point directly opposite to the first point, wherein the first height is greater than the second height.

10. A thermoformed plastic disposable lid for a drinking cup comprising:

a cover portion having a generally circular periphery, wherein the cover portion comprises an outside surface and an inside surface;

a drinking opening in the cover portion adjacent to the periphery;

a handle opening in the cover portion;

a pair of C-shaped rails extending downwardly from the inside surface of the cover portion, wherein the each of the pair of C-shaped rail comprises a top arm and a bottom arm, the top arm being coupled to the cover portion and the bottom arm positioned below the top arm, and wherein the C-shaped rails form a longitudinal channel between them, the channel extending from the handle opening to the drinking opening; and a sliding member having a handle and a nub, the handle located at one end of the sliding member and the nub located at another end of the sliding member, wherein the sliding member is configured to slidably fit into the channel and the sliding member is oriented such that the handle extends through the handle opening in the cover portion, such that when the handle is placed in a first position, the drinking opening is unplugged by the nub and when the handle is placed in a second position, the drinking opening is plugged by the nub, wherein the bottom arm of each C-shaped rail is tapered at a free end such that the sliding member can be snapped into the channel.

11. The lid of claim 10, wherein the cover portion further comprising an annular mounting portion surround the periphery of the cover portion for sealing the lid onto the cup.

12. A thermoformed plastic disposable lid for a drinking cup comprising:

a cover portion having a generally circular periphery, the cover portion comprising an outside surface and an inside surface;

a drinking opening in the cover portion adjacent to the periphery;

a handle opening in the cover portion;

a pair of C-shaped rails protruding downwardly from the inside surface of the cover portion, each C-shaped rail comprising a top arm and a bottom arm, the top arm being coupled to the cover portion and the bottom arm being positioned below the top arm, wherein the top arm and bottom arm of one rail faces the top arm and bottom arm of another rail to form a longitudinal channel between them, the channel extending from the handle opening to the drinking opening, and wherein each bottom arm is tapered at a free end; and a sliding member having a handle, wherein the sliding member is snapped into the channel via the tapered free ends of each of the C-shaped rails such that the sliding member slidably fits into the channel and the sliding member is oriented such that the handle extends through the handle opening in the cover portion, such that when the handle is placed in a first position, the drinking opening is uncovered by the sliding member and when the handle is placed in a second position, the drinking opening is covered by the sliding member.

13. The lid of claim 12, wherein the sliding member further comprises a nub such that when the handle is placed in the second position, the nub plugs the drinking opening.

* * * * *